US007636956B1

(12) United States Patent
Doucet

(10) Patent No.: US 7,636,956 B1
(45) Date of Patent: Dec. 29, 2009

(54) HANDS FREE TOILET SEAT SYSTEM

(76) Inventor: Sheryl Doucet, 23831 Stanwyck Cir., Tampa, FL (US) 33626

( * ) Notice: Subject to any disclaimer, the term of this patent is extended or adjusted under 35 U.S.C. 154(b) by 897 days.

(21) Appl. No.: 11/340,244

(22) Filed: Jan. 26, 2006

(51) Int. Cl.
*A47K 13/10* (2006.01)

(52) U.S. Cl. ..... 4/246.1; 4/246.5

(58) Field of Classification Search ..... 4/246.1–246.5
See application file for complete search history.

(56) References Cited

U.S. PATENT DOCUMENTS

| | | | | |
|---|---|---|---|---|
| 3,404,411 | A | 10/1968 | Newkirk | |
| 4,055,864 | A * | 11/1977 | Liu et al. | 4/246.1 |
| 4,975,988 | A | 12/1990 | Won | |
| 5,307,524 | A | 5/1994 | Veal | |
| 5,327,589 | A | 7/1994 | Rice | |
| 5,404,595 | A | 4/1995 | Carmel | |
| 5,603,127 | A | 2/1997 | Veal | |
| 6,067,667 | A * | 5/2000 | Suzuki | 4/246.1 |
| 6,230,336 | B1 | 5/2001 | Knoll et al. | |
| 6,321,393 | B1 * | 11/2001 | Jones | 4/246.1 |
| 6,643,852 | B1 * | 11/2003 | Lin | 4/246.1 |
| 6,651,262 | B1 | 11/2003 | Tinsley | |
| 6,775,854 | B2 | 8/2004 | Nichikawa et al. | |
| 2006/0242755 | A1 * | 11/2006 | Lohss | 4/246.1 |

* cited by examiner

*Primary Examiner*—Khoa D Huynh
(74) *Attorney, Agent, or Firm*—Edward P. Dutkiewicz

(57) ABSTRACT

A toilet bowl has a front end, a rear end and sides. A toilet seat has a bore. The bore extends through the toilet seat from side to side. A base plate on the toilet bowl has a forward, rearward and a central bearing. An input shaft on the rearward bearing has a first gear, a second gear and an intermediate slip clutch. An output shaft on the forward bearing extends through the cylindrical bore. A third gear and a lifting arm are coupled to the toilet seat. An intermediate shaft on the central bearing has a fourth gear in contact with the second and third gears. A motor with a pinion is coupled to the first gear. A switch actuates the motor.

7 Claims, 5 Drawing Sheets

FIG 1
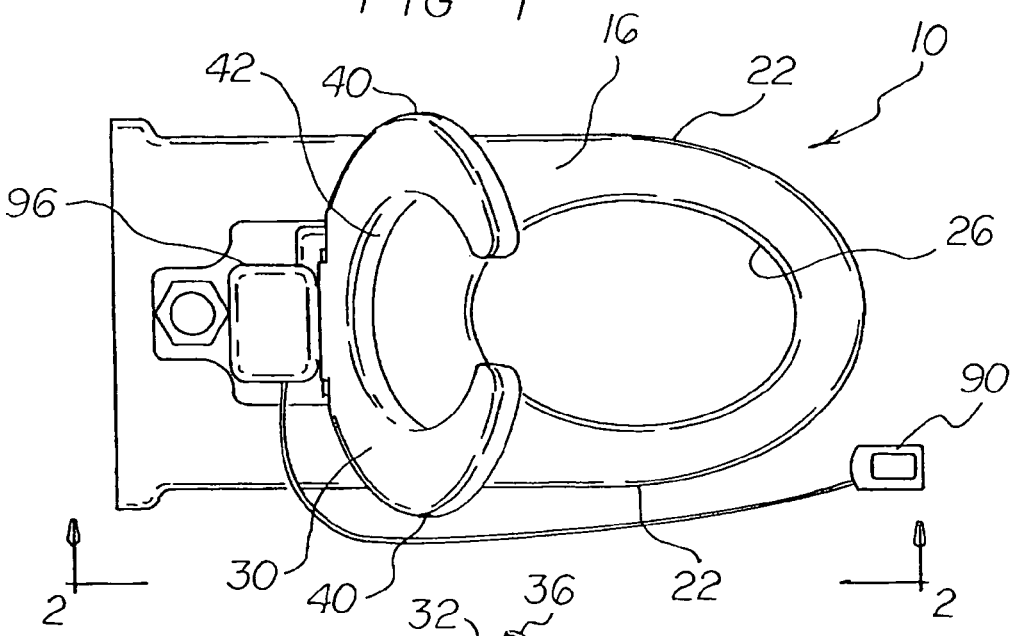
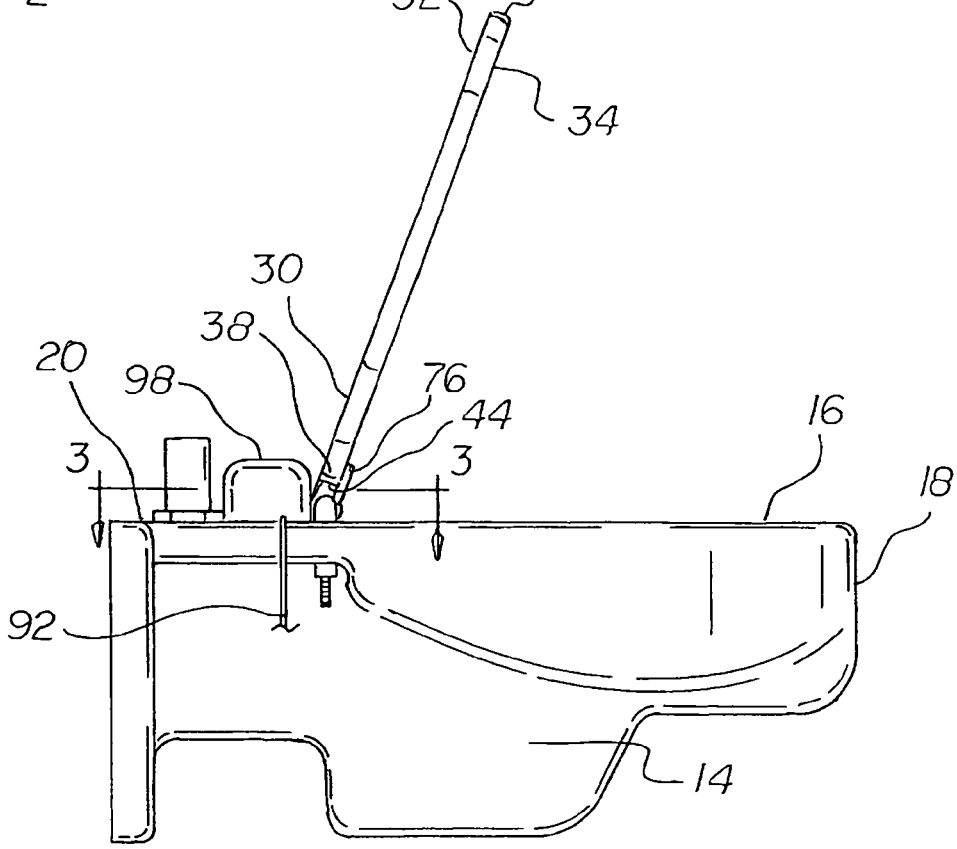
FIG 2

FIG 3
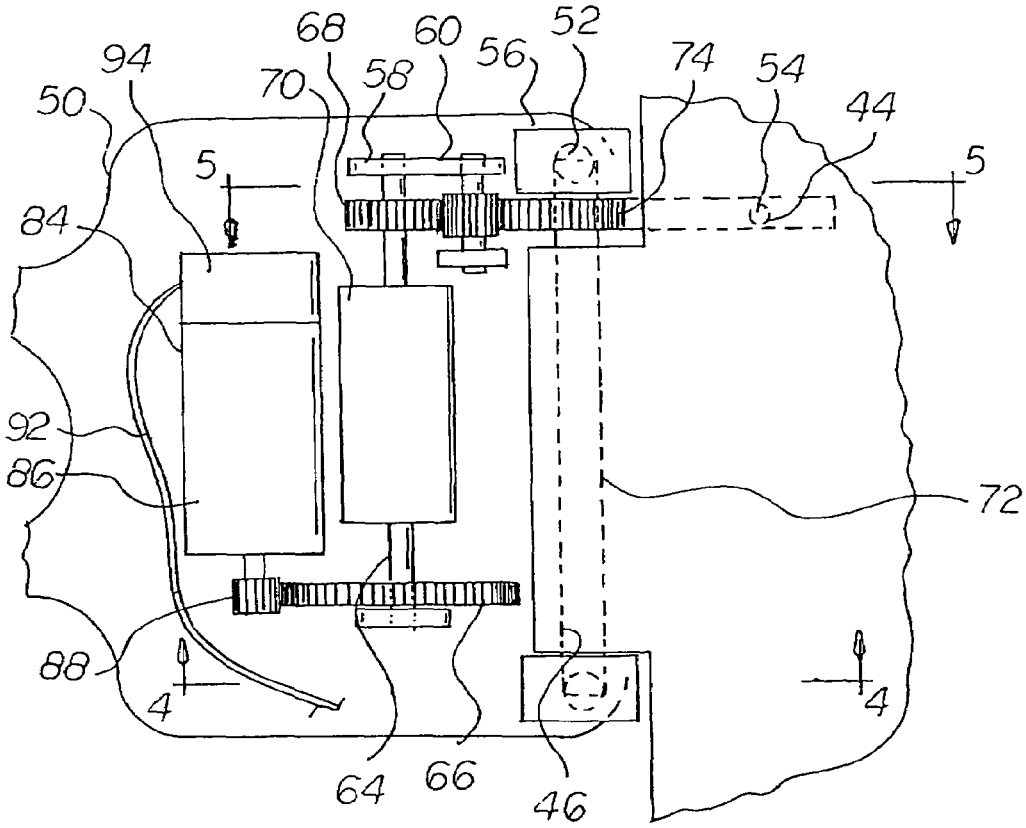
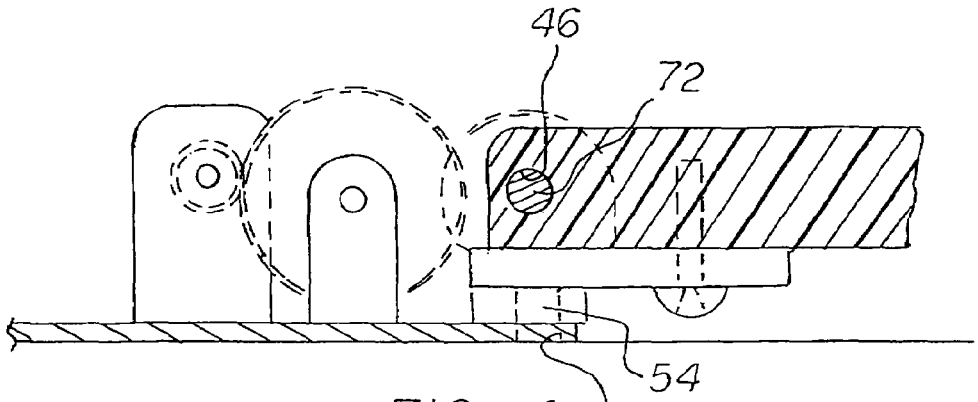
FIG 4

FIG 5
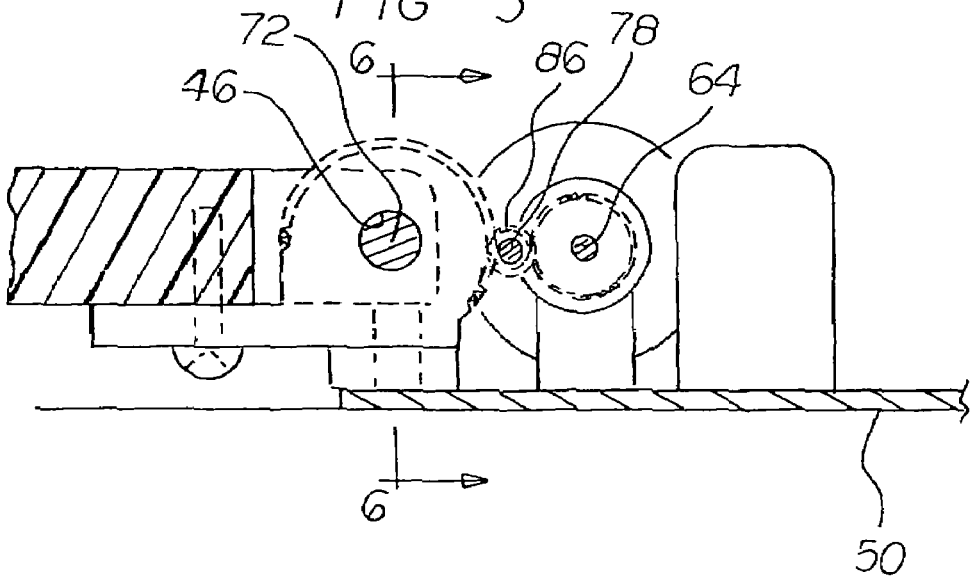
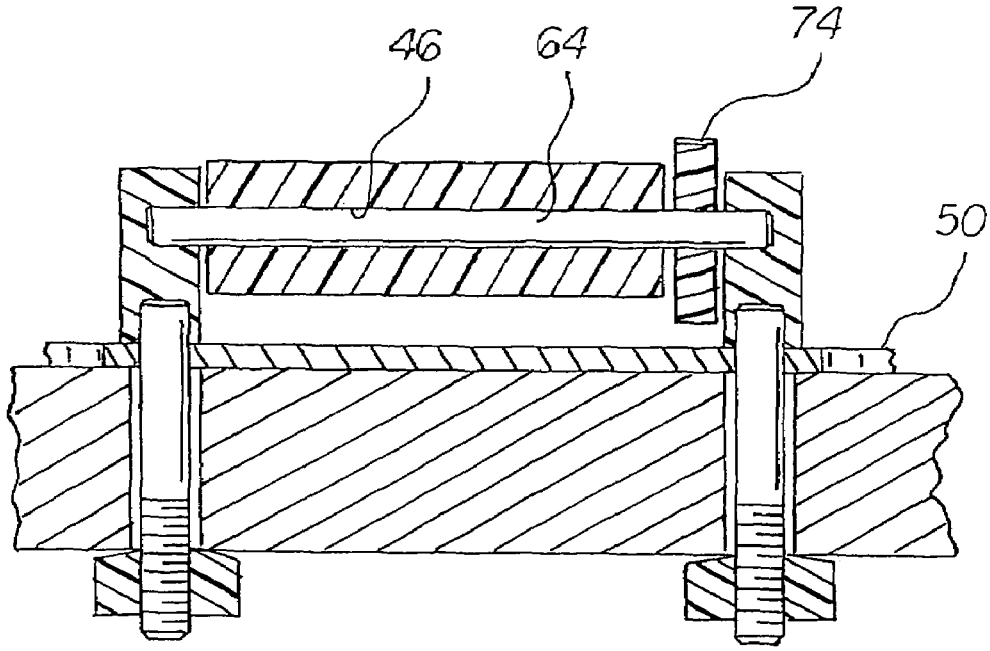
FIG 6

FIG 7
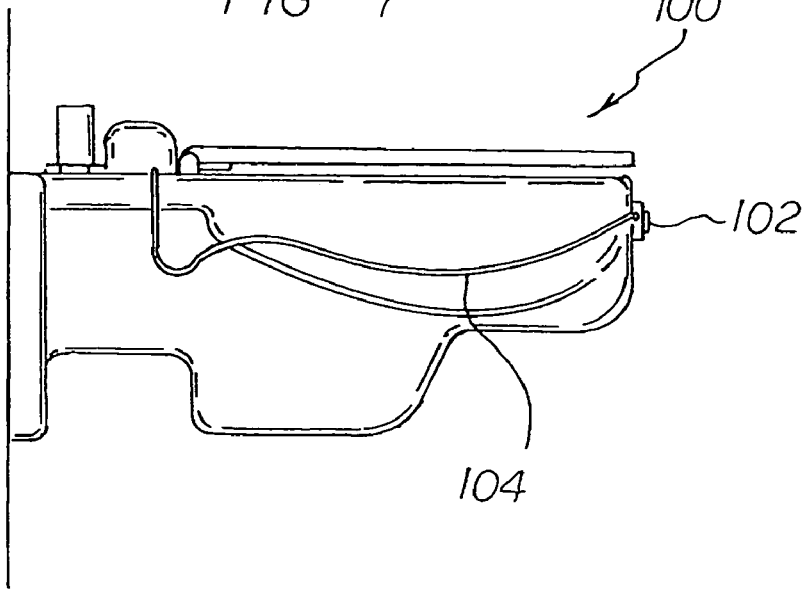
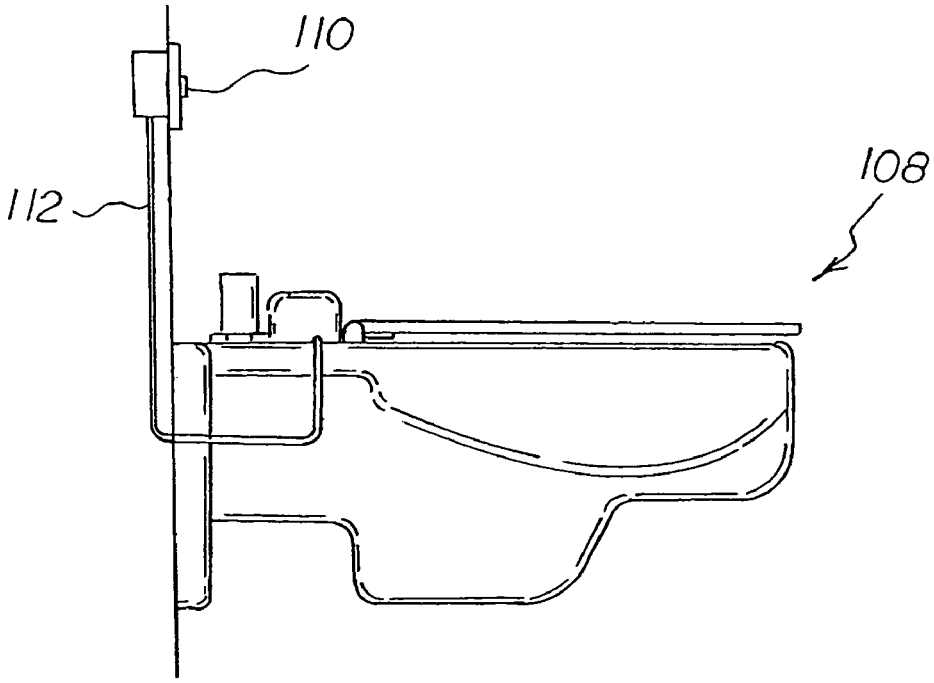
FIG 8

HANDS FREE TOILET SEAT SYSTEM

BACKGROUND OF THE INVENTION

1. Field of the Invention

The present invention relates to a hands free toilet seat system and more particularly pertains to allowing a user to raise and lower a toilet seat in a sanitary and convenient manner without touching the seat.

2. Description of the Prior Art

The use of toilet seat systems of known designs and configurations is known in the prior art. More specifically, toilet seat systems of known designs and configurations previously devised and utilized for the purpose of covering a toilet bowl through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,404,411 issued Oct. 8, 1968 to Newkirk relates to an Actuating Means for Toilet Seats and Lids. U.S. Pat. No. 5,307,524 issued May 3, 1994 to Veal relates to an Automatic Toilet Seat Device. U.S. Pat. No. 5,603,127 issued Feb. 18, 1997 to Veal relates to an Auto Flush for Tank Toilet. Lastly, U.S. Pat. No. 6,775,854 issued Aug. 17, 2004 to Nishikawa relates to a Toilet Cover Opening/Closing Device.

While these devices fulfill their respective, particular objectives and requirements, the aforementioned patents do not describe a hands free toilet seat system that allows a user to raise and lower a toilet seat in a sanitary and convenient manner without touching the seat.

In this respect, the hands free toilet seat system according to the present invention substantially departs from the conventional concepts and designs of the prior art, and in doing so provides an apparatus primarily developed for the purpose of allowing a user to raise and lower a toilet seat in a sanitary and convenient manner without touching the seat.

Therefore, it can be appreciated that there exists a continuing need for a new and improved hands free toilet seat system which can be used for allowing a user to raise and lower a toilet seat in a sanitary and convenient manner without touching the seat. In this regard, the present invention substantially fulfills this need.

SUMMARY OF THE INVENTION

In view of the foregoing disadvantages inherent in the known types of toilet seat systems of known designs and configurations now present in the prior art, the present invention provides an improved hands free toilet seat system. As such, the general purpose of the present invention, which will be described subsequently in greater detail, is to provide a new and improved hands free toilet seat system and method which has all the advantages of the prior art and none of the disadvantages.

To attain this, the present invention essentially comprises a hands free toilet seat system. First provided is a toilet bowl. The toilet bowl is adapted to be supported on a recipient surface. The toilet bowl has an upper surface. The toilet bowl has a front and a rear. The toilet bowl has sides provided between the front and the rear. The toilet bowl has an enlarged opening. The toilet bowl further has a plurality of mounting apertures. The mounting apertures are provided at the rear of the upper surface.

A toilet seat is provided. The toilet seat has an upper surface and a lower surface. The toilet seat has a front and a rear.

The toilet seat has sides provided between the front and rear. The toilet seat has an enlarged opening. The opening is adapted to overly the enlarged opening of the toilet bowl. Apertures are provided at the rear of the lower surface. A cylindrical bore is provided. The bore extends through the rear of the toilet seat from side to side.

Provided next is a base plate. The base plate is positioned on the upper surface of the toilet bowl adjacent to the rear. The base plate has a plurality of mounting apertures. The mounting apertures are aligned with the mounting apertures of the toilet bowl. Further included are threaded fasteners. The threaded fasteners extends through the mounting apertures. The treaded fasteners couple the base plate to the toilet bowl. Three bearing assemblies are mounted on the base plate. The bearing assemblies include a forward bearing assembly and a rearward bearing assembly and a central bearing assembly. Each bearing assembly is adapted to rotatably support a cylindrical shaft. The bearing assemblies are parallel with respect to each other and parallel with respect to the cylindrical bore.

Further provided is an input shaft. The input shaft is mounted on the rearward bearing assembly. The input shaft has a first gear. The input shaft has a second gear. The input shaft also has an intermediate slip clutch. The intermediate slip clutch is mounted on the input shaft between the first and second gears. In this manner rotation is provided about a first axis of rotation. An output shaft is provided. The output shaft is mounted on the forward bearing assembly. The output shaft extends through the cylindrical bore. A third gear is provided. The third gear is mounted on the output shaft. In this manner rotation is provided about a second axis of rotation. The third gear has a lifting arm. The lifting arm is coupled to the toilet seat for the raising and lowering of the toilet seat in response to the rotation of the third gear and the lifting arm. An intermediate shaft is provided. The intermediate shaft is mounted on the central bearing assembly. A fourth gear is provided. The fourth gear is mounted on the central shaft. In this manner rotation is provided about a third axis of rotation in driving contact with the second gear and the third gear.

Provided last is a drive assembly. The drive assembly is mounted on the base plate. The drive assembly has a motor and a pinion. The drive assembly is coupled to the first gear. In this manner activation of the motor drives the pinion to raise and lower the toilet seat. The drive assembly also includes an activation subassembly. The activation assembly includes a foot switch. The activation assembly includes an electrical line. The electrical line couples the foot switch and the motor. In this manner the toilet seat is raised upon the depressing of the foot switch. The drive assembly also includes a logic subassembly. The logic subassembly includes a timer. In this manner the toilet seat is lowered after a predetermined time following the energizing the motor through the depressing of the foot switch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hands free toilet seat system which has all of the advantages of the prior art toilet seat systems of known designs and configurations and none of the disadvantages.

It is another object of the present invention to provide a new and improved hands free toilet seat system which may be easily and efficiently manufactured and marketed.

It is further object of the present invention to provide a new and improved hands free toilet seat system which is of durable and reliable constructions.

An even further object of the present invention is to provide a new and improved hands free toilet seat system which is susceptible of a low cost of manufacture with regard to both materials and labor, and which accordingly is then susceptible of low prices of sale to the consuming public, thereby making such hands free toilet seat system economically available to the buying public.

Even still another object of the present invention is to provide a hands free toilet seat system for allowing a user to raise and lower a toilet seat in a sanitary and convenient manner without touching the seat.

Lastly, it is an object of the present invention to provide a new and improved hands free toilet seat system. A toilet bowl has a front end, a rear end and sides. A toilet seat has a bore. The bore extends through the toilet seat from side to side. A base plate on the toilet bowl has a forward, rearward and a central bearing. An input shaft on the rearward bearing has a first gear, a second gear and an intermediate slip clutch. An output shaft on the forward bearing extends through the cylindrical bore. A third gear and a lifting arm are coupled to the toilet seat. An intermediate shaft on the central bearing has a fourth gear in contact with the second and third gears. A motor with a pinion is coupled to the first gear. A switch actuates the motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a hands free toilet seat system constructed in accordance with the principles of the present invention.

FIG. 2 is side elevational view of the system taken along line 2-2 of FIG. 1.

FIG. 3 is a cross sectional view of the system taken along line 3-3 of FIG. 2.

FIG. 4 is a cross sectional view of the system taken along line 4-4 of FIG. 3.

FIG. 5 is a cross sectional view of the system taken along line 5-5 of FIG. 3.

FIG. 6 is a cross sectional view of the system taken along line 6-6 of FIG. 5.

FIG. 7 is a side elevational view similar to FIG. 2 but illustrating an alternate embodiment of the invention.

FIG. 8 is a side elevational view similar to FIGS. 2 and 7 but illustrating a second alternate embodiment of the invention.

The same reference numerals refer to the same parts throughout the various Figures.

DESCRIPTION OF THE PREFERRED EMBODIMENT

Figure 9:
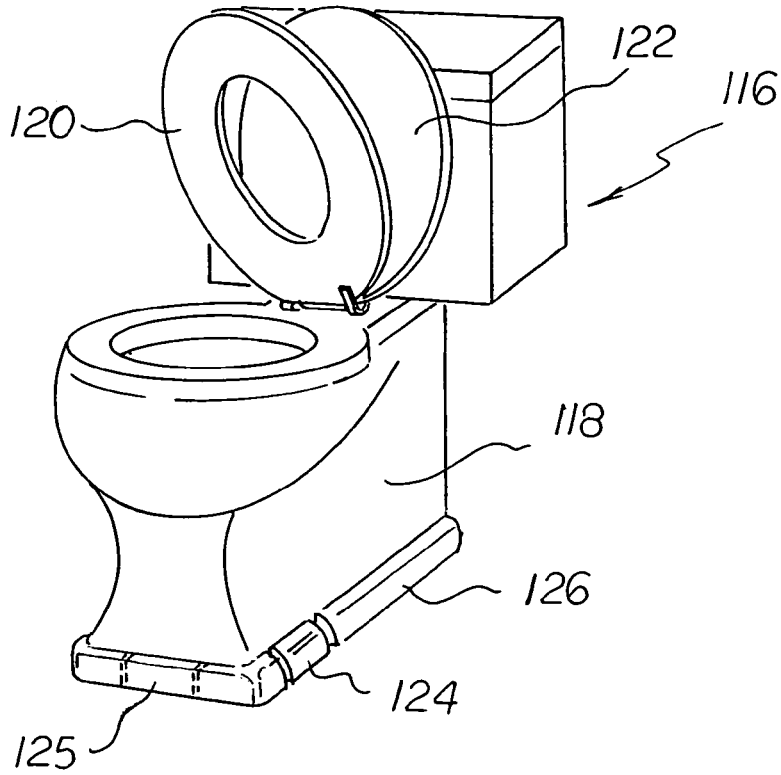
FIG. 9 is a perspective illustration of a third alternate embodiment of the invention.

With reference now to the drawings, and in particular to FIG. 1 thereof, the preferred embodiment of the new and improved hands free toilet seat system embodying the principles and concepts of the present invention and generally designated by the reference numeral 10 will be described.

The present invention, the hands free toilet seat system 10 is comprised of a plurality of components. Such components in their broadest context include a toilet bowl, a toilet seat, a base plate, shafts with gears and a slip clutch and a motor. Such components are individually configured and correlated with respect to each other so as to attain the desired objective.

First provided is a toilet bowl 14. The toilet bowl is adapted to be supported on a recipient surface. The toilet bowl has an upper surface 16. The toilet bowl has a front 18 and a rear 20. The toilet bowl has sides 22 provided between the front and the rear. The toilet bowl has an enlarged opening 24. The toilet bowl further has a plurality of mounting apertures 26. The mounting apertures are provided at the rear of the upper surface.

A toilet seat 30 is provided. The toilet seat has an upper surface 32 and a lower surface 34. The toilet seat has a front 36 and a rear 38. The toilet seat has sides 40 provided between the front and rear. The toilet seat has an enlarged opening 42. The opening is adapted to overly the enlarged opening of the toilet bowl. Apertures 44 are provided at the rear of the lower surface. A cylindrical bore 46 is provided. The bore extends through the rear of the toilet seat from side to side.

Provided next is a base plate 50. The base plate is positioned on the upper surface of the toilet bowl adjacent to the rear. The base plate has a plurality of mounting apertures 52. The mounting apertures are aligned with the mounting apertures of the toilet bowl. Further included are threaded fasteners 54. The threaded fasteners extends through the mounting apertures. The treaded fasteners couple the base plate to the toilet bowl. Three bearing assemblies are mounted on the base plate. The bearing assemblies include a forward bearing assembly 56 and a rearward bearing assembly 58 and a central bearing assembly 60. Each bearing assembly is adapted to rotatably support a cylindrical shaft. The bearing assemblies are parallel with respect to each other and parallel with respect to the cylindrical bore.

Further provided is an input shaft 64. The input shaft is mounted on the rearward bearing assembly. The input shaft has a first gear 66. The input shaft has a second gear 68. The input shaft also has an intermediate slip clutch 70. The intermediate slip clutch is mounted on the input shaft between the first and second gears. In this manner rotation is provided about a first axis of rotation.

An output shaft 72 is provided. The output shaft is mounted on the forward bearing assembly. The output shaft extends through the cylindrical bore. A third gear 74 is provided. The third gear is mounted on the output shaft. In this manner rotation is provided about a second axis of rotation. The third gear has a lifting arm 76. The lifting arm is coupled to the toilet seat for the raising and lowering of the toilet seat in response to the rotation of the third gear and the lifting arm.

An intermediate shaft 78 is provided. The intermediate shaft is mounted on the central bearing assembly. A fourth gear 80 is provided. The fourth gear is mounted on the central shaft. In this manner rotation is provided about a third axis of rotation in driving contact with the second gear and the third gear.

Provided last is a drive assembly 84. The drive assembly is mounted on the base plate. The drive assembly has a motor 86 and a pinion 88. The drive assembly is coupled to the first gear. In this manner activation of the motor drives the pinion to raise and lower the toilet seat. The drive assembly also includes an activation subassembly. The activation assembly includes a foot switch 90. The activation assembly includes an electrical line 92. The electrical line couples the foot switch and the motor. In this manner the toilet seat is raised upon the depressing of the foot switch. The drive assembly also includes a logic subassembly. The logic subassembly includes a timer 94. In this manner the toilet seat is lowered after a predetermined time following the energizing of the motor through the depressing of the foot switch.

The operational components which move during operation and use for raising and lowering the toilet seat are preferably shielded through a housing 98.

The use of a slip clutch between the gears of the input shaft allow the toilet seat to be raised and lowered by hand without the use of the motor. In addition, the initiation of the motor with a user on the toilet seat will allow the seat to remain lowered despite the force applied by the motor.

Reference is now made to the embodiment shown in FIG. 7. The system 100 includes a switch 102. The switch is a motion sensing switch. The switch is provided in the front of the toilet bowl. An electrical line 104 is provided. The electrical line couples the switch and the motor. In this manner the toilet seat is raised upon the sensing of a user by the switch.

Reference is now made to the embodiment shown in FIG. 8. The system 108 includes a switch 110. The switch is a wall mounted switch. The switch is in proximity to the toilet bowl. An electrical line 112 is provided. The electrical line couples the switch and the motor. In this manner the toilet seat is raised upon the depressing of the switch by the user.

FIG. 9 is a perspective illustration of a third alternate embodiment of the invention. This embodiment of the invention is a system 116 particularly adapted for use in residential applications. The toilet 118 and seat 120 and lid 122 as well as the operational components for raising and lowering the seat and/or lid are preferably the same in structure and function as in the prior embodiments. The pedal 124 which initiates the operation of the seat and lid is not a separately located switch. The switch is, rather, a segment of the periphery 126 of the toilet base located on the floor adjacent to the front of the toilet. This provides for greater esthetic appeal and, more importantly, renders the pedal in the same location at all times for ease of locating and use. An alternate location for the pedal is shown in FIG. 9 as pedal 125 on the front of the periphery of the toilet.

Figure 10:
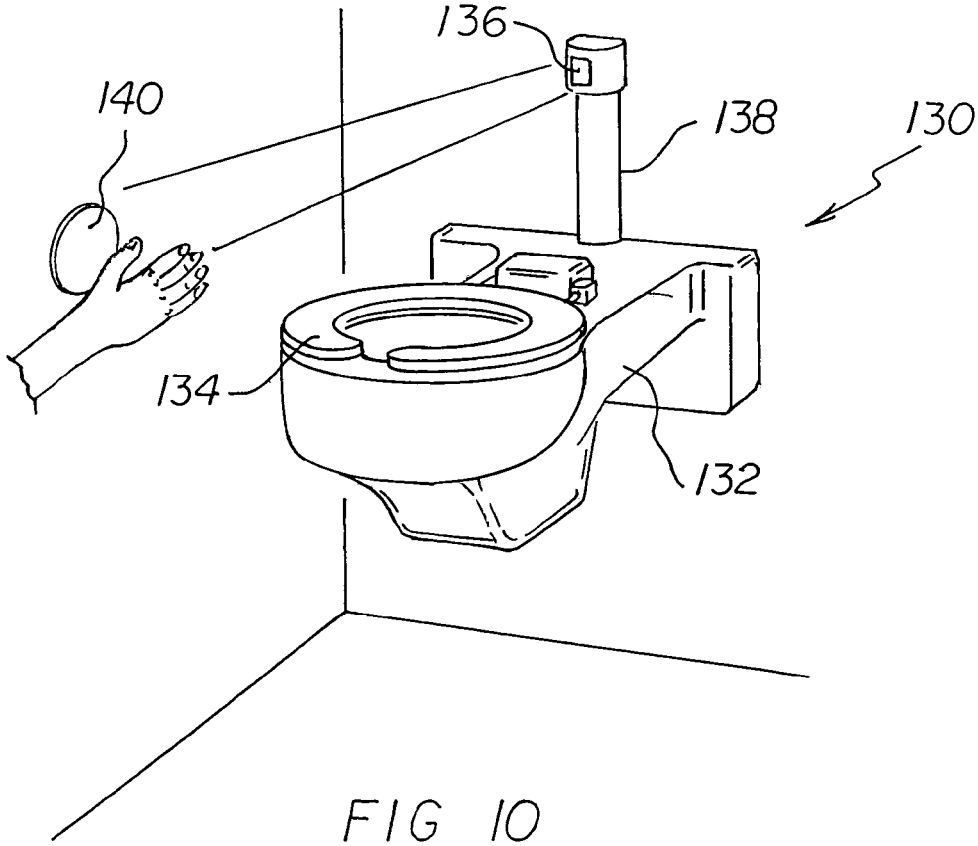
FIG. 10 is a perspective illustration of a fourth alternate embodiment of the invention.

A perspective illustration of a fourth alternate embodiment of the invention is shown in FIG. 10. This embodiment of the invention is a system 130 particularly adapted for use in commercial applications. The toilet 132 and seat 134 as well as the operational components for raising and lowering the seat and/or lid are preferably the same in structure and function as in the prior embodiments. The components which initiate the operation of the seat and lid include a motion detection activation device 136 on the ascending plumbing fixture 138. In association there with, is a sticker 140 with instructions for the user to wave his or her hand over the sticker. The sticker is located on the wall or stall in proximity to the toilet at essentially the same height as the activation device.

Note is taken that the embodiments of FIGS. 9 and 10, unlike the embodiments of FIGS. 1 through 8 and prior art approaches to automatic toilet seat raising, include a coupling between the switch and the motor for raising the toilet seat which is free of wires and cables. This preferred feature eliminates the possibility of entanglements by users as well as users attempting to locate the switch which may be repositioned between individual uses.

It should be understood that the structures for any of the toilets of the various embodiments may be of a wide variety of colors, multiple colors, color combinations and textures as well as being fabricated of substance such as ceramic, corian, synthetic, metal substances, including custom made with different glazes and finishes.

In cleaning toilets, the person cleaning the toilet normally has to bend over and touch a dirty toilet seat that harbors harmful bacteria from urine and feces. Cleanliness is especially important in a restaurant environment. Additionally, injury may occur to a user, especially at night when visibility is limited, if a toilet seat is left in the raised position. Eliminating the need to bend over to move the toilet seat position can help those with less flexibility. The system of the present invention allows the automatic raising and lowering of a toilet seat. The user will not have to touch a dirty toilet seat to raise or lower the toilet seat. This will abate the spread of e-coli and hepatitis. The user, in the preferred embodiment, can depress the pedal centered at the base of the toilet to activate the electrical mechanisms. Such mechanisms will activate the seat which will lift it to the raised position. A timer will designate when the seat will automatically lower. In an alternate embodiment, the pedal could be placed at the back of the toilet bowl near the tank or on the floor attached to the base. This would be internal and hidden from view. The foot pedal may be external and used to activate the system. Alternative activation systems include motion detection, voice activation, manual switch on the wall, etc.

Additionally, the present invention abates penile trauma in children because of premature toilet seat closure or inability to get out of the way before the toilet seat descends.

The present invention is very easy to use and very easy install on existing toilets or on new installations.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hands free toilet seat system for allowing a user to raise and lower a toilet seat in a sanitary and convenient manner comprising, in combination:

a toilet bowl adapted to be supported on a recipient surface; said toilet bowl having an upper surface (16) with a front (18), a rear (20), sides (22) provided between the front and the rear, and an enlarged opening (24); a plurality of mounting apertures (26) located at the rear of the upper surface;

a toilet seat having an upper surface and a lower surface; said toilet seat further comprises a front (36), a rear (38), sides (40) provided between the front and the rear, and an enlarged opening (42) overlying the enlarged opening (24) of said toilet bowl; an aperture (44) located at the rear of the lower surface and a cylindrical bore formed at the rear of said toilet seat and extended through the rear of the toilet seat from side to side;

a base plate positioned on the upper surface of said toilet bowl and adjacent to the rear (20) of said toilet bowl and the rear (38) of said toilet seat, said base plate having a plurality of mounting apertures (52) aligned with the mounting apertures (26) of said toilet bowl and further including threaded fasteners extending through the mounting apertures of both said toilet bowl and said base plate and coupling said base plate to said toilet bowl; three bearing assemblies mounted on said base plate including a forward bearing assembly, a rearward bearing assembly and a central bearing assembly, each bearing assembly adapted to rotatably support a cylindrical shaft parallel with respect to each other and parallel with respect to s cylindrical bore of said toilet seat;

an input shaft mounted on said rearward bearing assembly with a first gear disposed at an end of said input shaft, a second gear disposed at an opposite end of said input shaft, and an intermediate slip clutch mounted on said input shaft between the first and second gears for rotation there with about a first axis of rotation, wherein said intermediate slip clutch allows said toilet seat to remain lowered despite the force applied by said motor when the motor is activated while a user is on the toilet seat;

an output shaft mounted on said forward bearing assembly; said output shaft extending through said cylindrical bore of said toilet seat from side to side; a third gear mounted on an end of said output shaft for rotation therewith about a second axis of rotation, said third gear further having a lifting arm coupled to said toilet seat for the raising and lowering of said toilet seat in response to the rotation of said third gear and said lifting arm;

an intermediate shaft mounted on said central bearing assembly; a fourth gear mounted on said intermediate shaft for rotation therewith about a third axis of rotation, said fourth gear in direct driving contact with said second gear and said third gear;

a drive assembly mounted on said base plate adjacent to said rearward bearing assembly; said drive assembly comprising a motor and a pinion directly coupled to said first gear, whereby activation of the motor drives the pinion which in turn rotates said first gear, said second gear, said fourth gear, and said third gear with said lifting arm to raise and lower said toilet seat; said drive assembly also including an activation subassembly which comprises a switch coupled to said motor to energize said motor for raising the toilet seat upon the activation of said switch; said drive assembly also including a logic subassembly which comprising a timer for lowering the toilet seat after a predetermined time following the energizing said motor through the activation of said switch.

2. The system as set forth in claim 1 wherein the switch is a foot switch adapted to actuate the motor through the depressing of the foot switch.

3. The system as set forth in claim 1 wherein the switch is a motion sensing switch in the front of the toilet bowl with an electrical line coupling the switch and the motor for raising the toilet seat upon the sensing of a user by the switch.

4. The system as set forth in claim 1 wherein the switch is a wall mounted switch in proximity to the toilet bowl with an electrical line coupling the switch and the motor for raising the toilet seat upon the depressing of the switch by the user.

5. The system as set forth in claim 1 wherein the switch is a foot pedal located on the periphery of the toilet adjacent to the front of the toilet.

6. The system as set forth in claim 1 wherein the switch is a motion detection activation device positionable on an ascending plumbing fixture and a sticker with instructions for the user to wave his or her hand over the sticker, the sticker being located in proximity to the toilet at essentially the same height as the activation device.

7. The system as set forth in claim 1 and further including a coupling between the switch and the motor which is free of wires and cables.

* * * * *